United States Patent [19]

Eickmann

[11] 4,075,932

[45] Feb. 28, 1978

[54] ROTOR, PISTONS, PISTON SHOES AND ASSOCIATED MEANS IN FLUID HANDLING DEVICES

[76] Inventor: Karl Eickmann, 2420 Isshiki,, Hayama, Kanagawa, Japan

[21] Appl. No.: 666,003

[22] Filed: Mar. 11, 1976

Related U.S. Application Data

[63] Continuation of Ser. No. 321,854, Jan. 8, 1973, Pat. No. 3,967,540.

[30] Foreign Application Priority Data

Jan. 7, 1972 Austria ..... 2138/72

[51] Int. Cl.[2] ..... F01B 13/06

[52] U.S. Cl. ..... 91/488

[58] Field of Search ..... 91/487, 488, 498

[56] References Cited

U.S. PATENT DOCUMENTS

| | | | |
|---|---|---|---|
| 1,945,391 | 1/1934 | Bowedek | 91/503 |
| 2,103,313 | 12/1967 | Bowedek | 91/498 |
| 2,431,175 | 11/1947 | Hoffer | 91/492 |
| 3,255,706 | 6/1966 | Eickmann | 91/485 |
| 3,750,533 | 8/1973 | Thoma | 91/498 |

FOREIGN PATENT DOCUMENTS

| | | | |
|---|---|---|---|
| 801,678 | 9/1958 | United Kingdom | 91/487 |
| 1,132,001 | 10/1968 | United Kingdom | 91/487 |

*Primary Examiner*—William L. Freeh.

[57] ABSTRACT

This invention relates to fluid handling devices where fluid flows through a rotary body with thereto associated pistons and piston shoes for working as a motor, pump, engine or transmission, and wherein the improvement consists in the provision of recesses in the rotary body for the reception of parts of the piston shoes; in the provision of securing walls on the rotary body for preventing excessive axial displacement of the piston shoes, and in the provision of a backwards shoulder on the pistons of the device for preventing excessive backwards tilting of the piston shoes of the device.

7 Claims, 8 Drawing Figures

FIG 2
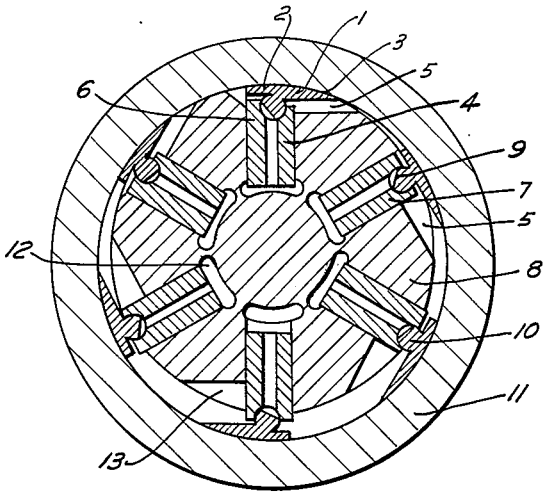
FIG. 1
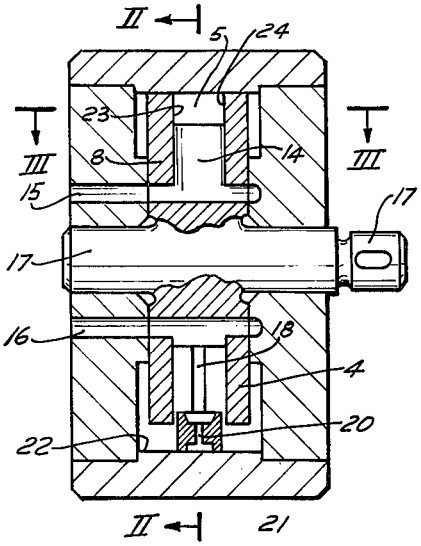
FIG. 3
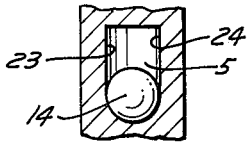
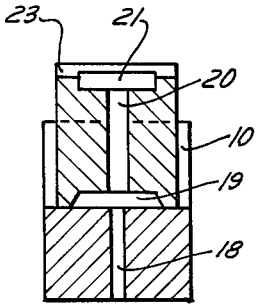
FIG. 6
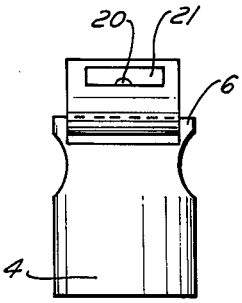
FIG. 5
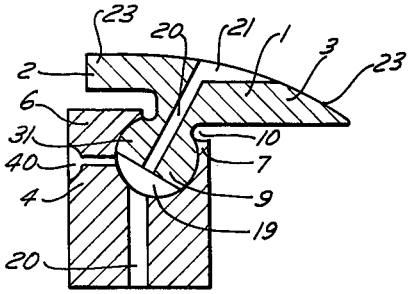
FIG. 4

FIG. 7
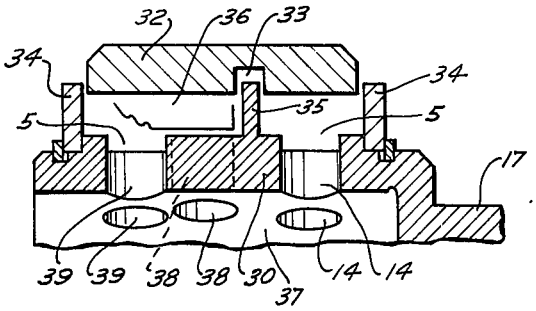
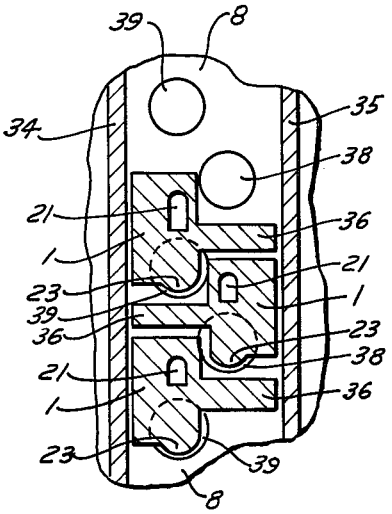
FIG. 8

ROTOR, PISTONS, PISTON SHOES AND ASSOCIATED MEANS IN FLUID HANDLING DEVICES

REFERENCE TO RELATED APPLICATION

This is a continuation application of my former patent application Ser. No. 321,854, filed on Jan. 8, 1973, now U.S. Pat. No. 3,967,540, issued on July 16, 1976.

BACKGROUND OF THE INVENTION

There are many radial piston pumps and motors, which have piston shoes and pistons associated thereto and where the piston shoes are guided inwards and outwards and mostly also endwards. Such devices work satisfactorily and reliably at certain sizes, pressures and revolutions. They are known for example from my U.S. Pat. Nos. 3,223,046; 3,270,685; 3,277,934; 3,304,883 and from many other patents.

Such radial piston pumps however, insofar as they had long piston strokes, had guide means for the piston shoes axially of the cylinders or of portions thereof, which resulted in relatively large axial dimensions of the device, that the number of piston groups therein remained limited, because otherwise the fluid passages in the rotor would become too long for effective work. And further, those devices commonly had a rotary actuator means for the actuation of the piston stroke, which was revolvably mounted in bearings.

More recently however it is desired, that radial piston pumps for example, operate with the rotary velocity of gas-turbines or of high speed revolving combustion engines. At those high rotary revolutions, however, the heretofore used guide means for the piston shoes are often unsatisfactory because the forward and backward acceleration forces on the piston shoes are becoming so high at such speeds, that the piston shoes tend to tilt a little in their guide means, which are very high speeds leads to welding between the guide faces of the piston shoes and of the guide means thereof. Also, the bearings for the actuator means are not able to revolve at such high revolutions, because their diameters are large in radial piston devices so that the velocity of the balls or rollers of the bearing would exceed their allowed maximum speed, if the pump runs at the speed of gasturbines or of high speed combustion engines. The bearings would then break.

SUMMARY OF THE INVENTION

It is an object of this invention to provide a rotary fluid handling device which is simple to be built, inexpensive, safe and effective in operation and which overcomes the limitations of the angular rotary velocity of the former fluid handling devices, while at same time the novel device of the invention reduces friction on the piston shoes and thereby increases the efficiency and power of the noval device.

The object of the invention is realized by the provision of one or more means of the invention, which for example, are:

a. The provison of a recess in the rotary fluid handling body for the reception of a portion, especially a forward portion of the piston shoe enable the piston shoe to enter into the fluid handling rotor itself for obtaining a large piston stroeke with a correspondingly large rate of flow of fluid through the devices to thereby increase the power of the device. At same time the diameter of the guide face of the actuator means can be kept small, so that the relation of the large piston stroke compared to the small diameter of the actuator face of the actuator means for the piston stroke gives a high efficiency of the device;

b. The provision of a forward extension of the piston shoe for making possible a high speed forward velocity of the piston shoe relative to the guide face of the actuator means, and at the same time provide space for the reception of fluid by hydrodynamic action between piston shoe and guide face or for the provision of space for the location of fluid pressure balancing recesses in the forwardly extending outer face of the piston shoe in order to get stable sliding of the piston shoe along the guide face of the piston shoe actuator;

c. The sizing of the piston shoe so that it is smaller than the recess in the rotor whereinto it enters;

d. The provision of space between the ends of the piston shoes and the walls of the recesses in the rotor, or of the walls attached to or provided on the rotor for the securing of the axial location of the piston shoes so that excessive axial dislocation of the piston shoes is prevented, while said spaces prevent sliding of piston shoe faces on wall faces and thereby eliminate friction by end guides of the piston shoes, which increases the efficiency of the device;

e. The provision of a backward shoulder on the piston and of a backward neck on the piston shoe, while said piston shoe shoulder extends radially almost to the outer face of the piston shoe and a limited space is provided between said shoulder and said neck, whereby the piston shoe can pivot in its seat in the piston forward and backward only to a limited extent, so that excessive backward inclination of the piston shoe is prevented and stopped by said neck and said shoulder. Thereby, the need to provide the heretofore used inner guides for the piston shoes is eliminated and consequenetely their friction is spared, which in turn improves the efficiency and power of the device;

f. The provision of the piston shoe pivot seat in the piston head and an opening extending therefrom at an inclination radially outward and forward, while the piston shoe itself is provided with a seat portion extending through said opening into said seat in said piston, whereby the piston can pivot in said piston to a limited extent and the piston shoe has a desired maximum of strength in the radial outward and forward direction, which is the direction of greatest load on the piston shoe, whereby the formed motion of the piston shoe is ideally borne by said piston;

g. The provision of a fluid containing fluid pressure balancing recess in the outside face of the piston shoe, extending forward in said piston shoe extension, and the association of a fluid pressure balancing recess thereto between the piston shoe seat and the piston shoe seat portion and thereby between the respective piston and piston shoe, for the reduction of friction between the piston and the piston shoe, the respective recesses being communicated by passages through said piston shoe and said piston to the respective associated cylinder;

h. The provision of a tangential fluid pressure balancing recess in the back wall of the piston for the reduction of friction between the piston wall and the cylinder wall, which recess is communicated by a passage means with the other recesses in the piston and piston shoe for thereby increasing the power and efficiency of the device and also the pressure handling capability of the device;

i. The provision of annular grooves in the actuator means for the partial reception of radial extensions or walls of the rotor or rotor assembly, for assuring a large piston stroke and thereby a large rate of flow of fluid through the device and thereby a large power of the device and/or:

k. The provison of wall means on the rotor extending axially of the actuator means and partially radially beyond the inner face thereof, for providing a securing means against excessive axial dislocation of the piston shoes over a large radial piston stroke range.

BRIEF DESCRIPTION OF THE DRAWINGS

FIG. 1 is a longitudinal sectional view through an embodiment of the invention;

FIG. 2 is a cross sectional view through FIG. 1 on the line II — II;

FIG. 3 is a fragmentary section through FIG. 1 on the line III — III.

FIG. 4 is a fragmentary longitudinal sectional view through a piston-piston shoe assembly of the invention;

FIG. 5 is a front view of FIG. 4;

FIG. 6 is a crosssectional view through FIG. 4;

FIG. 7 is a longitudinal sectional view through an embodiment of a multi cylinder group rotor of the invention with the thereto associated walls and actuator means; and FIG. 8 is a fragmentary developed view of the rotor in FIG. 7.

DESCRIPTION OF THE PREFERRED EMBODIMENTS

Housing or actuator means 11 has an inner face 22 for guiding the piston stroke of the piston shoes 1 and pistons 4 radially into and out of the cylinders 14 in rotor body 8. Body 8 is the fluid handling body for the reception of fluid to flow therethrough. Body 8 may have a shaft 17 for rotation in the housing, the body 8 or shaft 17 being supported in the housing 11 or in the covers thereof.

Passages 15 and/or 16 may lead the fluid through the covers into out of the cylinders 14 of the rotary fluid handling body 8.

According to the invention, the rotary fluid handling body 8 is provided with recesses 5 for the temporary reception of all or a portion of a respective piston shoe 1 or its front extension 3. The recess 5 of the invention is bounded by walls 24 for the prevention of excessive axial dislocation of the piston shoes 1 relative to pistons 4. Each piston 4 and piston shoe 1 are connected together by a piston head seat 9 so that the associated extension 3 is pivotable. A smaller front portion 7 and a wider back portion 6 of the respective piston 4, embrace the piston head seat 9 a little, so that it cannot radially disassemble. The narrowed portion between the piston shoe head 2 and the seat 9 extends radially outward and forward in an inclined direction through the opening 10 of an piston head. The front extension 3 enters into the respective recess 5 for obtaining the desired large piston stroke, and the the piston shoe head 2 is shorter than the portion 6, but slightly spaced therefrom, so that the piston shoe 1 can pivot a little on piston head seat 9. The piston shoe head 2 has also the outer face 23 which slides along the actuator means 11 inner actuator face 22. The pistons 4 and the associated piston shoes 1 each have have a passage 20 for the transfer of fluid from the associated cylinder into and through the balancing recess 19 between piston and piston shoe and into the outer balancing recess 21 which may be directed forward and radially outward at an inclination selected for the most suitable high speed operation of the device. A tangentially directed balancing recess 40 may be formed in the portion 6 of the piston 4 and be communicated with passage 20 or recess 19 for extending fluid pressure against the wall of cylinder 14 to reduce friction between the piston 4 and such wall. Balancing recesses 12 may be provided the cover and rotor 8 in order to ashure the suitable floating of the rotor 8 during revolution between fields of fluid of equal dimension or force on both ends of the rotor 8.

The device of the invention can also be a multi piston group or a multi flow device. Such an embodiment is shown in FIGS. 7 and 8. It has a rotary control face 37 for engagement with a stationary control face on a respective control body. Cylinder group 14 has recesses 5 of the invention and wall 35 and 34 for the prevention of excessive dislocation of the piston shoes. Cylinder groups 38 and 39 are so closely together in rotor 30, that they may need only the two walls 34 and 35 for operation of both piston shoe groups. The piston shoes will then have axial extensions 36 for preventing excessive axial dislocation of the piston shoes. Actuator ring 32, along the inner face of which the outer faces 23 of the piston heads 2 slide, may have an annular groove 33 for the partial reception of wall means 35 and be short enough so that the wall 34 can extend radially beyond the inner face 22 of actuator ring 32, for the purpose of obtaining the desired very large piston stroke of the device of the invention.

In actual tests the device of FIG. 7 had a diameter of 70 mm only and a length of about 60 mm; at a weight of only 1800 grams this device developed 80 HP.

What is claimed is

1. In a fluid-handling machine of the type having a housing formed with a cavity having an inner circumference, a rotor body rotatably mounted in said cavity and having an outer periphery and a plurality of radial cylinder bores extending inwardly thereof, and a plurality of pistons each slidably accommodated in one of said cylinder bores, a plurality of recesses formed in said outer periphery of said rotor body, each intersecting the outer end of one of said cylinder bores and extending from the associated cylinder bore in one circumferential direction of said rotor body; a plurality of piston shoes each located adjacent the outer end of one of said cylinder bores and pivotably connected to the piston accommodated therein, said piston shoes each having an outwardly directed face in sliding engagement with said inner circumference and an extension projecting transversely of and beyond the associated cylinder bore in said one circumferential direction of said rotor body, said cylinder bores, recesses and piston shoes being configurated so that in the fully retracted position of the respective piston shoe the same is located substantially entirely within the associated recess and outer end of the associated cylinder bore without projecting beyond the outer periphery of said rotor body, the improvement comprising that said recesses extend in said rotor body only in direction forwardly of the axis of a respective piston, whereas the backward clyinder wall portion extends uninterrupted radially toward the outer radial end of said rotor body for guiding the respective portions of the respective pistons at the outer portion of the piston stroke.

2. In a machine as defined in claim 1, wherein some of said plurality of cylinder bores and their respectively-associated pistons are spaced about the circumference of said rotor body in a first group, and wherein others of said plurality of cylinder bores and their respectively-associated pistons are spaced about the circumference of said rotor body in a second group which is spaced in axial direction from said first group.

3. In a machine as defined in claim 2; and further comprising wall means on said rotor body extending radially of said outer periphery towards said inner circumference at opposite axial sides of the respective piston shoes of said first group for preventing axial displacement of the same in axial direction of said rotor body.

4. In a machine as defined in claim 2, wherein said second group comprises two subgroups of cylinder bores and their respectively-associated pistons which are axially spaced of each other.

5. In a machine as defined in claim 4; and further comprising wall means on said rotor body extending radially of said outer periphery towards said inner circumference at opposite axial sides of the respective piston shoes of said two subgroups of said second group, each of piston shoes respectively-associated with said pistons of said second group having an axial extension for preventing axial displacement of the same in axial direction of said rotor body.

6. In a machine as defined in claim 5, wherein the axial extensions of one of said subgroups extend in a direction oppositely away from the direction in which the axial extensions of the other of said subgroups extend.

7. In a machine as defined in claim 5; and further comprising an annular groove formed in said inner circumference, said wall means extending in part into said groove.

* * * * *